US006356193B1

(12) United States Patent
Liou

(10) Patent No.: US 6,356,193 B1
(45) Date of Patent: Mar. 12, 2002

(54) SELF SAFETY-PROTECTION BURGLARPROOF DEVICE

(76) Inventor: Young Chuan Liou, 2F, No. 297, Wen Lin Rd., Shrlin District, Taipei (TW)

( * ) Notice: Subject to any disclaimer, the term of this patent is extended or adjusted under 35 U.S.C. 154(b) by 0 days.

(21) Appl. No.: 09/930,988

(22) Filed: Aug. 17, 2001

(51) Int. Cl.[7] ..... E05B 45/06

(52) U.S. Cl. ..... 340/542; 340/5.1; 340/5.2; 340/5.31; 340/5.62; 340/5.8

(58) Field of Search ..... 340/542, 545.1, 340/545.2, 548, 549, 545.3, 545.4, 545.6, 545.7, 545.8, 545.9, 5.1, 5.2, 5.21, 5.22, 5.23, 5.31, 5.53, 5.55, 5.6, 5.65, 5.7, 5.71, 5.72, 5.73, 5.8, 5.83, 5.62

(56) References Cited

U.S. PATENT DOCUMENTS 5,337,588 A * 8/1994 Chhatwal ..... 70/278.3
5,552,777 A * 9/1996 Gokcebay et al. ..... 340/5.54
5,677,682 A * 10/1997 Thorsen et al. ..... 340/5.65
5,774,043 A * 6/1998 Mizuno et al. ..... 340/426
5,905,446 A * 5/1999 Benore et al. ..... 340/5.7
5,933,085 A * 8/1999 Holcomb et al. ..... 340/5.66
6,005,487 A * 12/1999 Hyatt, Jr. et al. ..... 340/5.65
6,064,316 A * 5/2000 Glick et al. ..... 340/5.65

* cited by examiner

*Primary Examiner*—Daniel J. Wu
*Assistant Examiner*—Toan Pham
(74) *Attorney, Agent, or Firm*—Rosenberg, Klein & Lee

(57) ABSTRACT

The present invention proposes a self safety-protection burglarproof device comprising an uninterruptible power system, an image-capturing unit, an access unit, a lock head, a receiver, a server, a lock mechanism, a control unit, sensing units, and a case-reporting unit. The lock head is at an on state so that input power can be provided to the receiver when the keyhole of the lock head is inserted by a key. When the receiver receives a remote-control signal emitted by an emitter, the server will activate the control unit to stay at a state of alert, and the lock mechanism will be driven to unlock. Therefore, gangsters or burglars can be deterred and arrested in time to more assure public order or safety of inhabitation.

7 Claims, 1 Drawing Sheet

SELF SAFETY-PROTECTION BURGLARPROOF DEVICE

FIELD OF THE INVENTION

The present invention relates to a self safety-protection burglarproof device and, more particularly, to a self safety-protection burglarproof device having higher security effect.

BACKGROUND OF THE INVENTION

In a general security burglarproof system installed in a large building, a plurality of video cameras and sensors matched with a control center are used to achieve monitoring and protection function. However, every resident family must pay considerable administrative expenses.

In a domestic security burglarproof system, a video camera, a door lock mechanism, a sensing unit, a receiver, and so on are used to achieve monitoring and protection function. The receiver is used to receive a remote-control signal emitted by an emitter, discriminate the serial code in the signal, and unlock the lock mechanism if conformity is obtained.

However, burglars still can decrypt the code to unlock the lock mechanism through the help of a code reader or a decoder, hence achieving the object of housebreaking.

SUMMARY OF THE INVENTION

One object of the present invention is to provide a self safety-protection burglarproof device having higher security effect, wherein electricity is provided to a receiver after one inserts a key into the key hole of a lock head, and the receiver will activate a control unit to keep the control unit at a state of alert and to drive a server to unlock the lock mechanism when the receiver receives a remote-control signal emitted by an emitter.

Another object of the present invention is to provide a self safety-protection burglarproof device having higher security effect to deter gangsters and burglars and to arrest them in time, thereby more assuring public order and security of inhabitation.

Yet another object of the present invention is to provide a self safety-protection burglarproof device having higher security effect, whereby security function can be achieved by itself without the need of paying administrative expenses.

The various objects and advantages of the present invention will be more readily understood from the following detailed description when read in conjunction with the appended drawing, in which:

DETAILED DESCRIPTION OF THE PREFERRED EMBODIMENTS

Figure 1:
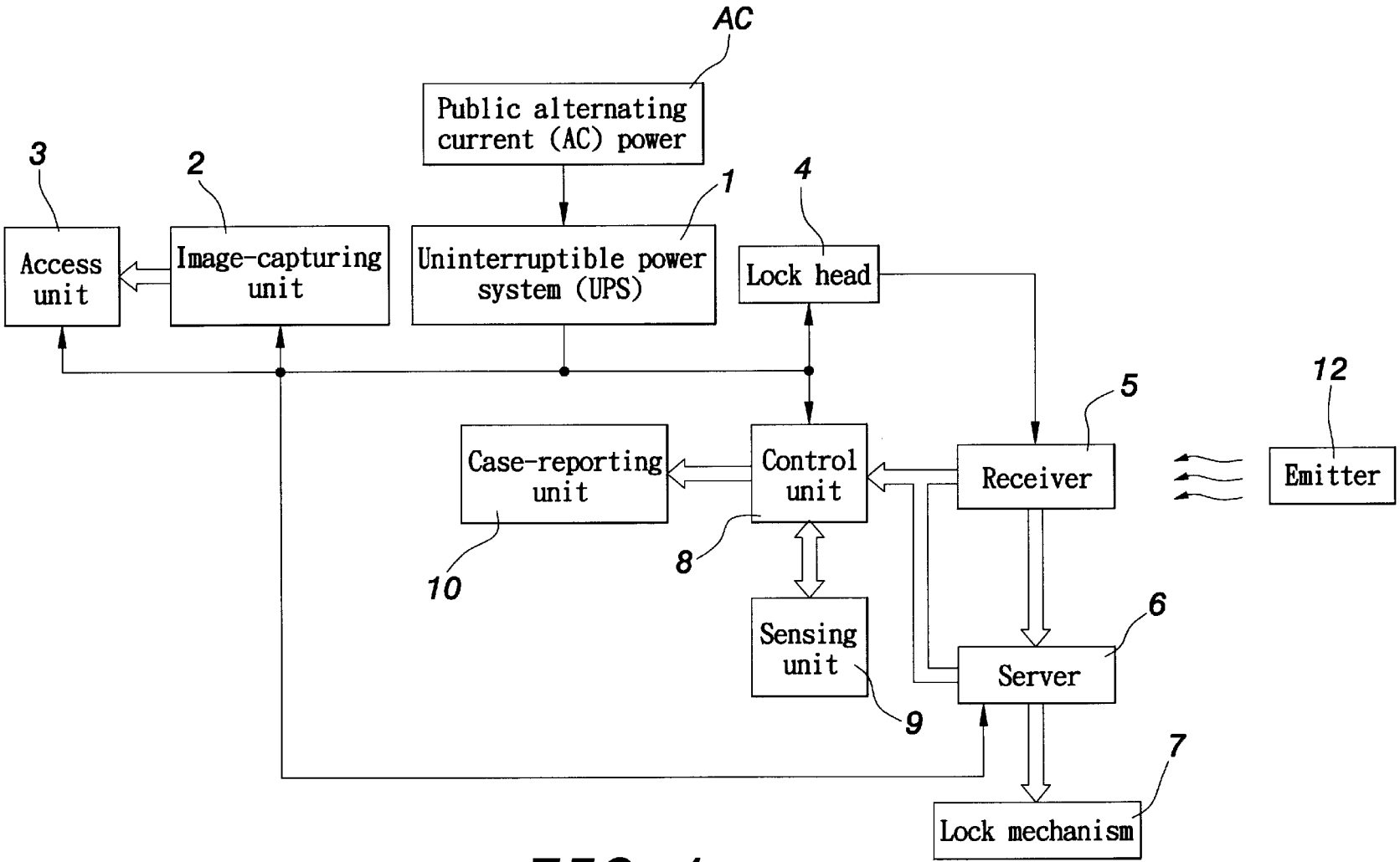
FIG. 1 is an architecture diagram of the present invention.

As shown in FIG. 1, the present invention provides a self safety-protection burglarproof device comprising an uninterruptible power system (UPS) 1, an image-capturing unit 2, an access unit 3, a lock head 4, a receiver 5, a server 6, a lock mechanism 7, a control unit 8, sensing units 9, and a case-reporting unit 10.

The uninterruptible power system 1 will switch to a power-supplying state when public alternating current (AC) power is cut off. In the present invention, the uninterruptible power system 1 provides electric power for the image-capturing unit 2, the access unit 3, the lock head 4, the server 6, and the control unit 8.

The image-capturing unit 2 can be a pinhole video camera or a monitor, and the position thereof can be designed according to different space configurations. The output terminal of the image-capturing unit 2 is connected to the access unit 3. The access unit 3 can be a video recorder, a digital video recorder, or a memory unit. The image-capturing unit 2 and the access unit 3 are connected to the uninterruptible power system 1.

The image-capturing unit 2 is used to capture images and transfer video signals to the access unit 3 for storage.

One end of the lock head 4 is connected to the uninterruptible power system 1, and the other end thereof is connected to the receiver 5. The lock head 4 can be disposed at a door entrance. A keyhole thereof can be inserted by a key.

An on state is achieved after the keyhole of the lock head 4 is inserted by a key so that public AC power or the uninterruptible power system can provide working power for the receiver 5. In other words, power can only be supplied to the receiver 5 when the lock head 4 is at an on position. After finishing the set action, the user can switch the lock head 4 to an off position.

The receiver 5 is used to receive a remote-control signal emitted by an emitter 12, and to discriminate whether the code of the emitter 12 is in agreement.

The input terminal of the server 6 is connected to the output terminal of the receiver 5. The server 6 is also connected to the uninterruptible power system 1, the lock mechanism 7, and the control unit 8. The lock mechanism 7 can be disposed at a secret position indoors such as an indoor door or window.

The server 6 is functioned by the output signal of the receiver 5, and provides electricity to drive the lock mechanism 7.

The control unit 8 is connected to the uninterruptible power system 1, the receiver 5, and a plurality of sensing units 9. The sensing units 9 can be acoustic sensors, magnetic stripes, or vibration elements. The sensing units 9 are disposed on glass or at other appropriate positions. The output terminal of the control unit 8 is connected to the case-reporting unit 10.

The control unit 8 can be controlled by the receiver 6 to stay at a state of alert or a state of release. When at the state of alert, the control unit 8 can be used to discriminate whether the sensing units 9 operate at their normal positions connected in series or whether the output signals of the sensing units 9 are kept at normal positions connected in series. If any sensing unit is destroyed at the state of alert, a command is transferred to the case-reporting unit 10 for immediate processing.

When a burglar wants to unlock from outside, if he does not let the lock head 4 be on and only remotely controls the receiver 5 by the emitter 12, because the receiver 5 does not have working power from the public AC power or the uninterruptible power system 1, the lock mechanism 7 will not be activated. There is also no power letting the internal code of the receiver 5 leak out so that a gangster or a burglar can activate the server 6 to drive the lock mechanism 7 through the help of a code reader or a decoder. Although the key can let the lock head 4 be on, if there is not the emitter 12 to remotely control the receiver 5, the server 6 cannot drive the lock mechanism 7 to act. Therefore, double protection function is achieved. That is, in order to simultaneously let the control unit 8 stay at a state of alert or a state of release and let the server 6 drive the lock mechanism 7 to act, it is necessary to let the lock head 4 be on and the receiver 5 receive a remote-control signal from the emitter 12, thereby unlocking or locking the lock mechanism 7.

Moreover, when a burglar touches or damages the sensing units 9 from outside, the control unit 8 will automatically transfer a command to the case-reporting unit 10 for immediate processing, hence deterring gangsters or burglars and arresting them in time.

To sum up, the present invention has the following characteristics.

1. After the system has been installed, it is not necessary to pay administrative expenses or other expenses.
2. Double protection function can be achieved.
3. It is easy to deter gangsters or burglars and to arrest them in time.
4. More security and safety of inhabitation can be achieved.
5. Features of gangsters or burglars can be provided to the police when a case occurs.
6. Passkeys cannot be used to directly unlock the lock mechanism.
7. Internal code readers or decoders cannot read or decode the code after the system is at the state of alert or the state of alert is released.
8. It is not necessary to worry about that the system is dead when a blackout occurs.
9. It is not necessary to worry about that the householder cannot unlock the door and set or release the state of alert when a blackout occurs.
10. No matter the lock head is at the on or off position, the control unit cannot enter into the state of alert when any sensing unit is not at its normal position connected in series.
11. Once a condition occurs at a sensing unit, it is not necessary to worry about the morality of the policeman for on-site processing.
12. Because the lock mechanism is disposed indoors, gangsters or burglars cannot know from outside to damage or forcibly unlock the lock mechanism.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A self safety-protection burglarproof device, comprising:

an input power source;

a lock head connected to said input power source, a keyhole thereof being at an on state after being inserted by a key;

a receiver connected to said lock head, working power thereof coming from input power when said lock head is at the on state, said receiver being used to receive a remote-control signal emitted by an emitter and to discriminate the signal;

a server connected to said input power source and an output terminal of said receiver and controlled by an output signal of said receiver; and a lock mechanism connected to an output terminal of said server and driven by current of said server to act.

2. The self safety-protection burglarproof device as claimed in claim 1 further comprising an image-capturing unit for capturing images, said image-capturing unit being connected to said input power source, an output terminal of said image-capturing unit being connected to an access unit, which is used to access output signals of said image-capturing unit.

3. The self safety-protection burglarproof device as claimed in claim 1 further comprising a control unit, said control unit being connected to said input power source, said receiver, said server, and a plurality of sensing units, an output terminal of said control unit being connected to a case-reporting unit, said control unit receiving output signals of said server to act, said control unit being controlled by said receiver to stay at a state of alert or a state of release, said control unit being used to discriminate whether said sensing units operate normally or receive output signals of said sensing units to transfer a command to said case-reporting unit for immediate processing.

4. The self safety-protection burglarproof device as claimed in claim 2, wherein said image-capturing unit can be a pinhole video camera or a monitor.

5. The self safety-protection burglarproof device as claimed in claim 2, wherein said access unit can be a video recorder, a digital video recorder, or a memory unit.

6. The self safety-protection burglarproof device as claimed in claim 3, wherein said sensing units can be acoustic sensors, magnetic stripes, or vibration elements.

7. The self safety-protection burglarproof device as claimed in claim 1, wherein said input power source can be public alternating current power or an uninterruptible power system, and said uninterruptible power system can switch to a power-supplying state when a blackout occurs.

* * * * *